US007001017B2

(12) United States Patent
Lee et al.

(10) Patent No.: US 7,001,017 B2
(45) Date of Patent: Feb. 21, 2006

(54) DRIVE ROLLER RELEASING APPARATUS FOR INK-JET PRINTER

(75) Inventors: Yong-duk Lee, Gunpo (KR); Heon-soo Park, Sungnam (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/234,316

(22) Filed: Sep. 5, 2002

(65) Prior Publication Data

US 2003/0122913 A1 Jul. 3, 2003

(30) Foreign Application Priority Data

Dec. 29, 2001 (KR) ..... 2001-0088426

(51) Int. Cl.
*B41J 2/01* (2006.01)
*B41J 13/02* (2006.01)
*B41J 13/08* (2006.01)

(52) U.S. Cl. ..... 347/104; 347/101; 400/636

(58) Field of Classification Search ..... 347/101, 347/104; 400/636, 637, 637.1, 639
See application file for complete search history.

(56) References Cited

U.S. PATENT DOCUMENTS 4,944,620 A * 7/1990 Scozzafava et al. ..... 400/608.1
5,046,873 A * 9/1991 Fare ..... 400/639.1
5,221,035 A * 6/1993 Suzuki et al. ..... 226/181
5,226,743 A * 7/1993 Jackson et al. ..... 400/625
5,241,331 A * 8/1993 Chiku ..... 346/134
5,358,230 A * 10/1994 Ikemori et al. ..... 271/114
5,838,338 A * 11/1998 Olson ..... 347/8
6,369,878 B1 * 4/2002 Zevin et al. ..... 355/97

FOREIGN PATENT DOCUMENTS

JP 57049586 A * 3/1982
JP 58181669 A * 10/1983
JP 59164168 A * 9/1984
JP 7-33279 2/1995
JP 7-261605 10/1995
JP 11-15221 1/1999

* cited by examiner

*Primary Examiner*—Manish Shah
*Assistant Examiner*—Leonard Liang
(74) *Attorney, Agent, or Firm*—Staas & Halsey LLP

(57) ABSTRACT

A drive roller releasing apparatus for an ink-jet printer includes a drive roller separating mechanism at a drive roller to transport a printing material to a feed roller, to separate a pinch roller from the drive roller, and a controller to control the drive roller separating mechanism to separate the pinch roller from the drive roller when the printing material is moved into the feed roller. The drive roller separating mechanism includes a releasing cam to contact a pinch roller shaft. The cam surface is such that the pinch roller is gradually separated from the drive roller due to a rotation of the drive roller shaft. A one-way clutch allows the releasing cam to be rotated in one direction, and a torsion spring to bias the releasing cam to rotate in one direction in order for the cam surface thereof to be contacting with the pinch roller shaft.

30 Claims, 7 Drawing Sheets

DRIVE ROLLER RELEASING APPARATUS FOR INK-JET PRINTER

CROSS-REFERENCE TO RELATED APPLICATIONS

This application claims the benefit of Korean Application No. 2001-88426, filed Dec. 29, 2001, in the Korean Intellectual Property Office, the disclosure of which is incorporated herein by reference.

BACKGROUND OF THE INVENTION

1. Field of the Invention

The present invention relates to an ink-jet printer, and more particularly to a drive roller releasing apparatus for the ink-jet printer that prevents curling of print material being produced by a drive roller assembly during printing.

2. Description of the Related Art

Generally, a printer connected to a computer makes copies of document or other information held by the computer on print materials. There are various types of printers, such as laser printers or ink-jet printers. The ink-jet printer electrostatically sprays ink from a nozzle onto a print material, such as paper, and prints document or information held by the computer onto the print materials.

Referring to FIG. 1, a conventional ink-jet printer comprises a pick-up roller 10, a drive roller assembly 20, a feed roller 30, a printing unit 40, and a discharge roller 50. The pick-up roller 10 separates one print material 1 from the other print materials stacked within a printing material cassette 11, and moves the print material 1 into the drive roller assembly 20. The drive roller assembly 20 moves the print material 1 transferred from the pick-up roller 10.

Referring to FIGS. 1, 2 and 3, the drive roller assembly 20 includes a pinch roller 24, a pinch spring 26, a drive roller 21, a gear train 27, and a drive motor 28. The pinch roller 24 is parallel with the drive roller 21 and is pressed against the drive roller 21 by the pinch spring 26. A drive gear 23 is co-axially disposed at one end of the drive roller 21, and meshes with the gear train 27. The drive motor 28 is disposed on a frame 29 mounted in a body of the ink-jet printer. A pinion 28*a,* which meshes with the gear train 27, is disposed at a shaft of the drive motor 28. The feed roller 30 feeds the print material 1 transferred from the drive roller assembly 20 to be below the printing unit 40. The printing unit 40 prints on the print material 1 fed from the feed roller 30. The discharge roller 50 discharges the print material 1 on which information is printed by the printing unit 40.

In the ink-jet printer constructed as above, an operation of printing is described below referring to FIGS. 1 to 2. The print material 1 is separated from the printing material cassette 11 and is moved into the drive roller assembly 20 by the pick-up roller 10. The print material 1 transferred by the pick-up roller 10 is moved into a gap between the drive roller 21 and the pinch roller 24 of the drive roller assembly 20, and is then moved into the feed roller 30 by a friction force caused by a pressure between the drive roller 21 and the pinch roller 24. The feed roller 30 feeds the print material 1 transferred from the drive roller assembly 20 for predetermined lengths of the print material 1 and intervals to a printing head of the printing unit 40. Then, for each predetermine length of the print material 1, the printing head, moving from side to side, prints information onto the print material 1 fed by the feed roller 30. After printing on the predetermined length of the print material 1 is completed, the printing material 1 is again fed for the predetermined length to be below the printing unit 40 using the drive roller assembly 20 and the feed roller 30. If printing on the total length of the print material 1 is completed through the procedure described above, the printed print material 1 is discharged by the discharge roller 50. The predetermined length discussed above is determined in accordance with the printing head's size.

However, the ink-jet printer printing through the above-described procedure has a problem that the images printed on the print material are inferior. This problem is due to a band feed accuracy not being good when the feed roller 30 feeds the print material 1 at the predetermined length to be below the printing unit 40.

Referring to FIGS. 3 and 4, the reason of bad band feed accuracy is described as follows. When a front end of the print material 1 transferred by the pick-up roller 10 is moved into the gap between the drive roller 21 and the pinch roller 24, the drive roller 21 is rotated clockwise by the drive motor 28. As the drive roller 21 is rotated, the print material 1 is moved to the feed roller 30 by the friction force that is caused by the pressure force of the pinch spring 26 pressing the pinch roller 24 against the drive roller 21. The front end of the print material 1 passed by the drive roller assembly 20 is guided by first and second printing material guides 32,34, and is thus moved into the feed roller 30. If the front end the print material 1 is moved into the feed roller 30, the feed roller 30 and the drive roller 21, which are synchronously controlled by a controller (not shown), feed the printing material 1 at the predetermined length to the to be below the printing head of the printing unit 40.

At this time, the portion print material 1 between the drive roller 21 and the feed roller 30 has a curl 1' formed during the guidance by the first and second printing material guides 32, 34 as shown in FIG. 4. Because each of the drive roller 21 and the feed roller 30 feeds the printing material 1 with the same speed, the curl 1' is maintained until a back end of the print material 1 is leaves the drive roller 21.

Because the front end of the print material 1 is pushed in the feed roller's direction by a force caused by a spring back effect of the curl 1', the printing material 1 is fed beyond the predetermined length. But when the back end of the printing material 1 leaves the drive roller 21, the curl 1' disappears, and the force, which otherwise pushes the print material 1 in the feed roller's direction, vanishes. Therefore, the printing material 1 is fed by the feed roller 30 by exactly predetermined length. In other words, during the printing for the total length of the print material 1, a feed length moved by the feed roller 30 while the printing material has the curl 1' is different from a feed length moved by the feed roller 30 while the print material 1 does not have the curl 1'. Accordingly, the band feed accuracy of the print material 1 by the feed roller 30 deteriorates. When the band accuracy of the printing material deteriorates, the print quality consequently deteriorates.

SUMMARY OF THE INVENTION

Therefore, it is an object of the present invention to provide a drive roller releasing apparatus of an ink-jet printer, in which there is no curl of a print material so that feed accuracy of the print material by a feed roller is improved.

Additional objects and advantages of the invention will be set forth in part in the description which follows and, in part, will be obvious from the description, or may be learned by practice of the invention.

To achieve the above and other objects, a drive roller releasing apparatus for an ink-jet printer according to an embodiment of the present invention includes a drive roller separating mechanism disposed at a shaft of a drive roller, which transports a printing material to a feed roller, to separate a pinch roller, which is contacted longitudinally with the drive roller and applies pressure to the drive roller, from the drive roller; and a controller to control the drive roller separating mechanism to separate the pinch roller from the drive roller when the print material is moved into the feed roller.

According to an aspect of the invention, the drive roller separating mechanism includes a releasing cam disposed at the drive roller shaft so that a cam surface of the releasing cam contacts a pinch roller shaft, where the cam surface is such that the pinch roller is gradually separated from the drive roller according to a rotation of the drive roller shaft; a one-way clutch disposed between the releasing cam and the drive roller shaft, to allow the releasing cam to be rotated in one direction; and a torsion spring inserted at the drive roller shaft, the torsion spring to bias the releasing cam to rotate in one direction in order for the cam surface of the releasing cam to contact the pinch roller shaft.

According to another aspect of the invention, the one-way clutch is rotated counterclockwise.

According to still another aspect of the invention, a distance that the pinch roller is separated from the drive roller is 2 mm.

According to yet another aspect of the invention, the drive roller does not rotate if the drive roller shaft is rotated in a reverse direction within a predetermined angle, and then is rotated in the reverse direction according to a rotation of the drive roller shaft if the drive roller shaft is rotated in the reverse direction above the predetermined angle.

According to still yet another aspect of the invention, the predetermined angle is 10 degrees.

Additional objects and advantages of the invention will be set forth in part in the description which follows and, in part, will be obvious from the description, or may be learned by practice of the invention.

BRIEF DESCRIPTION OF THE DRAWINGS

The foregoing and other objects, features and advantages of the invention will be apparent and more readily appreciated from the more particular description of embodiments of the invention, as illustrated in the accompanying drawings in which like reference characters refer to the like parts throughout the different figures.

DETAILED DESCRIPTION OF THE EMBODIMENTS

Figure 1:
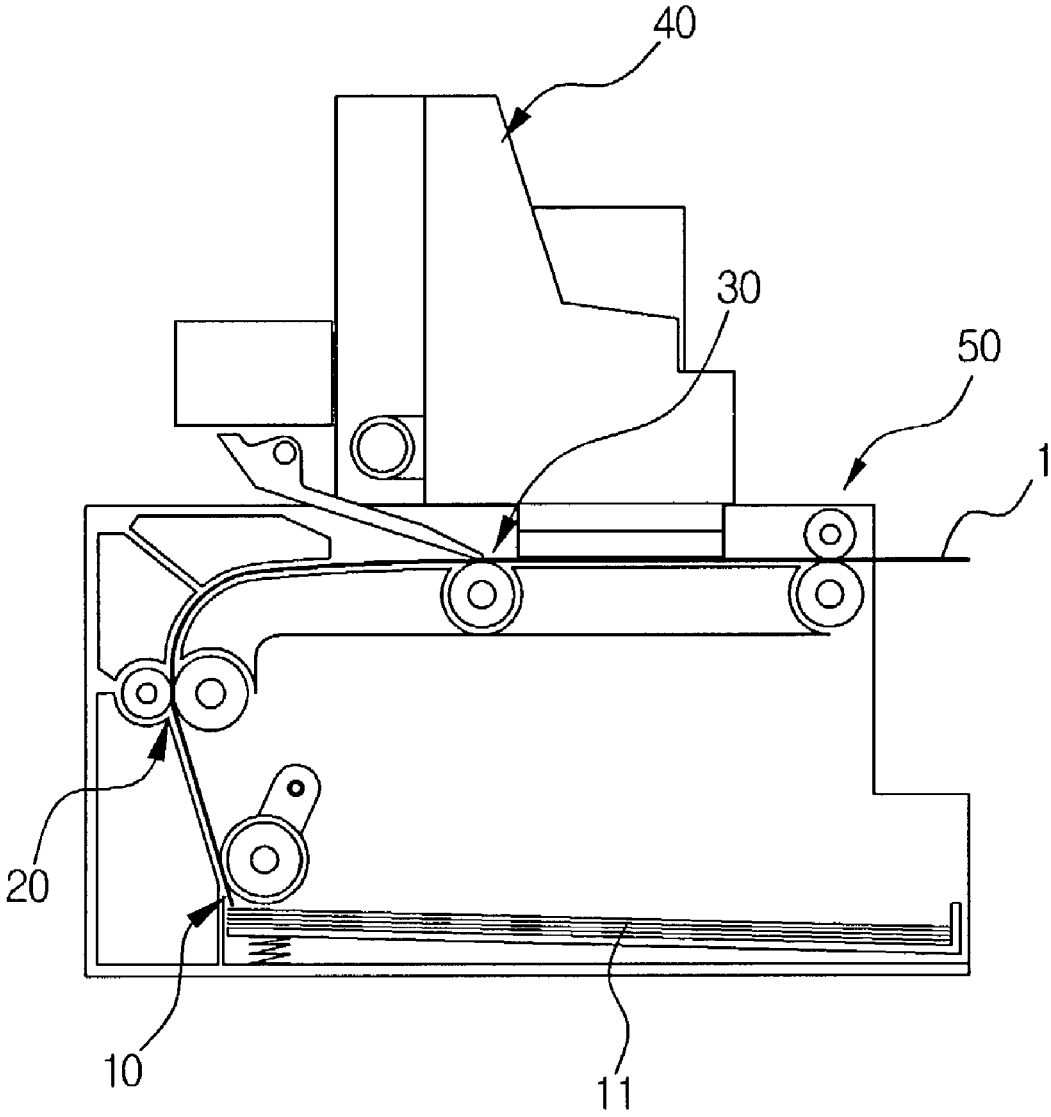
FIG. 1 (PRIOR ART)
FIG. 1 is a cross-sectional view schematically showing a conventional ink-jet printer.
Figure 2:
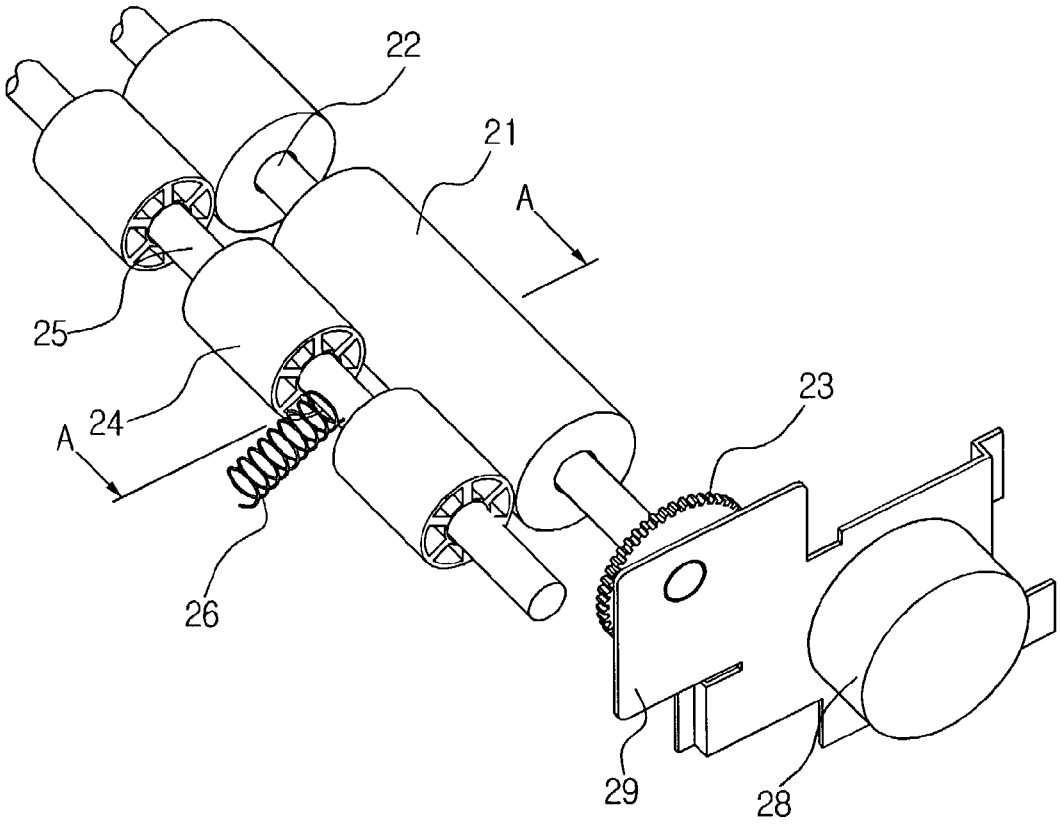
FIG.2 (PRIOR ART)
FIG. 2 is a perspective view showing a drive roller assembly of FIG. 1.
Figure 3:
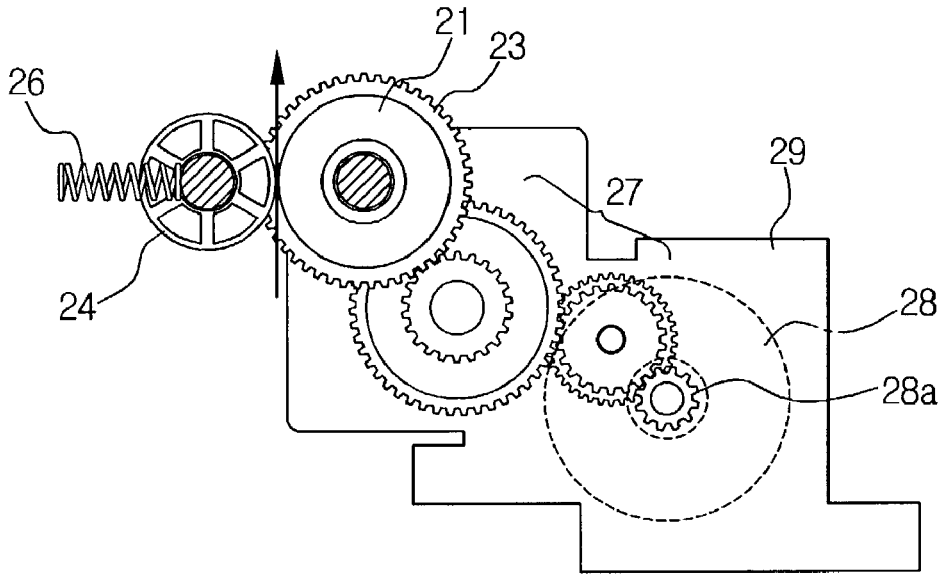
FIG.3 (PRIOR ART)
FIG. 3 is a cross-sectional view of the drive roller assembly taken along line A—A of FIG. 2.
Figure 4:
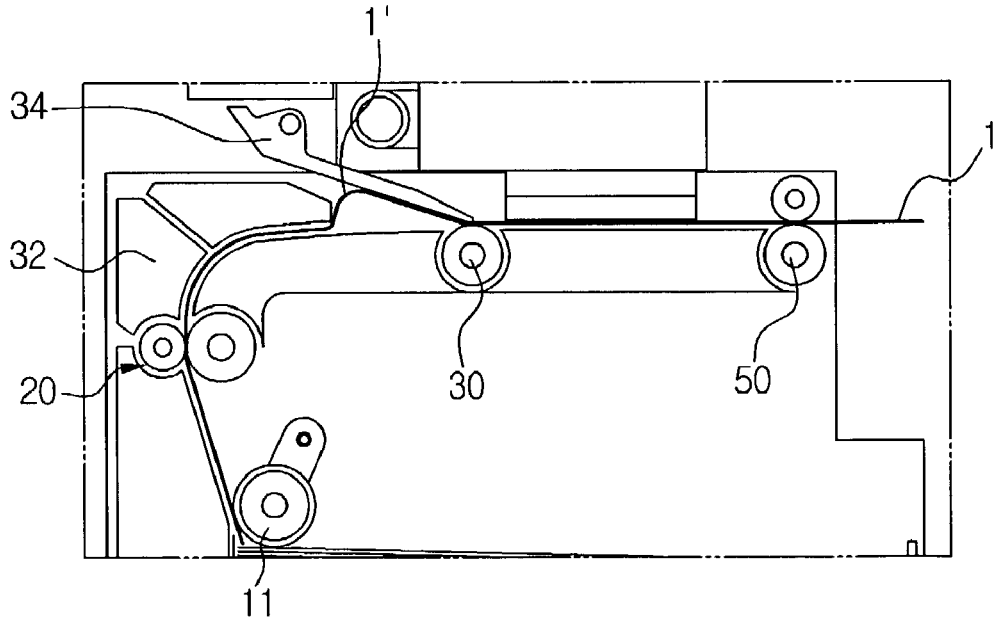
FIG.4 (PRIOR ART)
FIG. 4 is a cross-sectional view showing a curl of a print material in the conventional ink-jet printer of FIG. 1.
Figure 5:
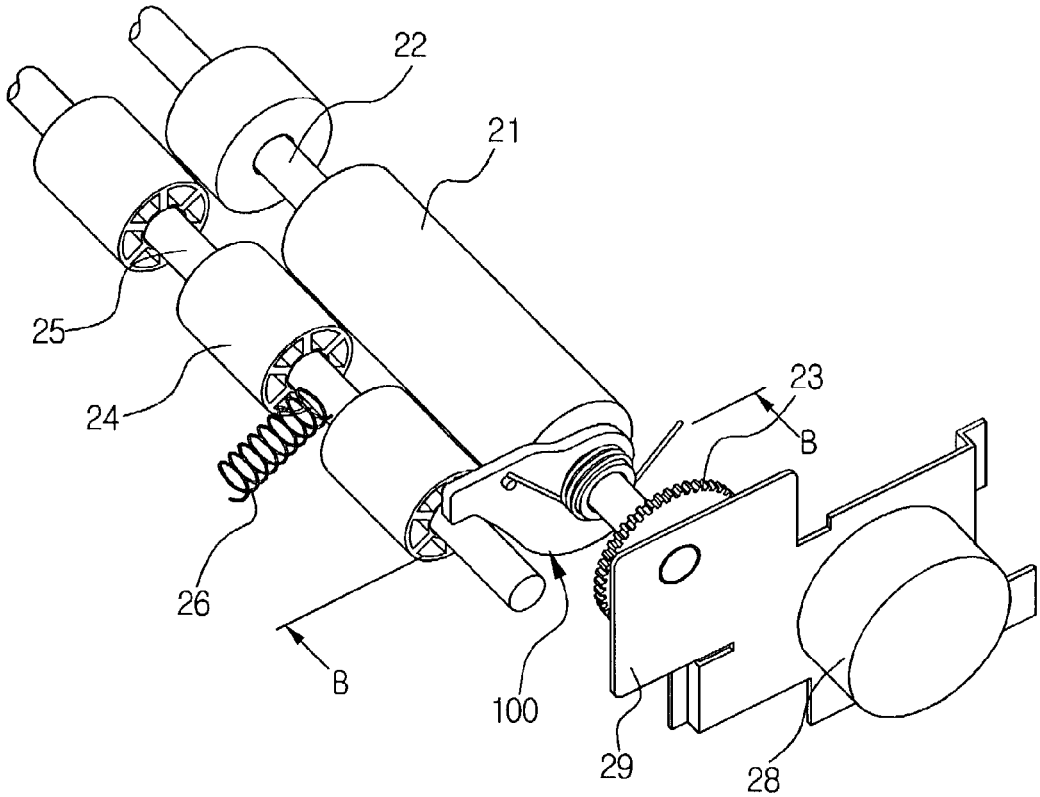
FIG. 5 is a perspective view showing a drive roller assembly having a drive roller releasing apparatus of an ink-jet printer according to an embodiment of the present invention.
Figure 6:
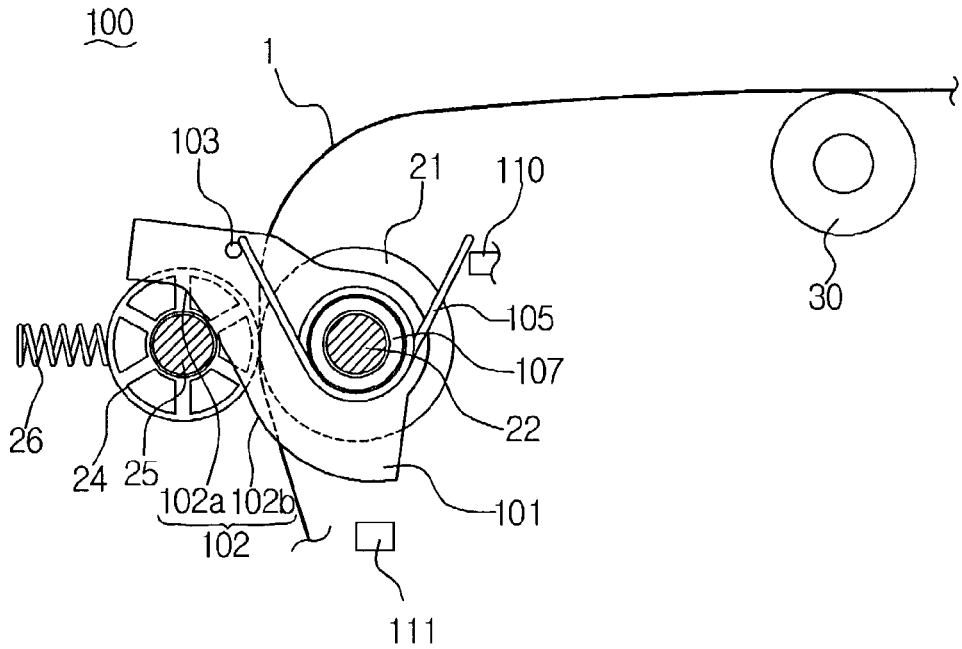
FIG. 6 is a cross-sectional view showing the drive roller assembly taken along line B—B of FIG. 5 when a drive roller separating mechanism is not operated.
Figure 7:
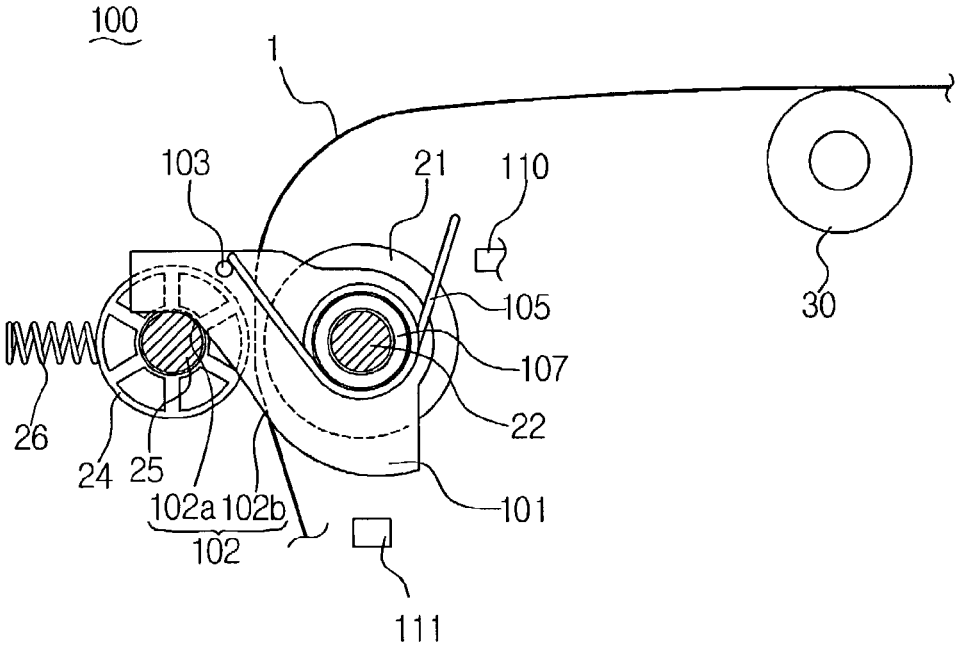
FIG. 7 is a cross-sectional view showing the drive roller assembly taken along line B—B of FIG. 5 when a drive roller separating mechanism is operated.

The embodiments of the present invention will be described in greater detail below by referring to the accompanying drawings, wherein like reference numerals refer to the like elements throughout. The embodiments are described below in order to explain the present invention by referring to the figures.

Referring to FIGS. 5 through 7 and 9, a drive roller releasing apparatus according to an embodiment of the present invention comprises a drive roller separating mechanism 100 and a controller 60. The drive roller separating mechanism 100 includes a releasing cam 101, a torsion spring 105, and a one-way clutch 107. The releasing cam 101 is disposed at a drive roller shaft 22. A cam surface 102 of the cam 101 remains in contact with a pinch roller shaft 25. When a lower part 102*b* of the cam surface 102 of the releasing cam 101 contacts the pinch roller shaft 25, the drive roller 21 is pressed by the pinch roller 24. When an upper part 102*a* of the cam surface 102 contacts the pinch roller shaft 25, the pinch roller 24 is separated at a predetermined distance from the drive roller 21. Therefore, when the releasing cam 101 is rotated counter-clockwise, the cam 101 is at a releasing state such that the pinch roller 24 is separated at the predetermined distance from the drive roller 21. When the releasing cam 101 is rotated clockwise, the cam 101 is at a pressure state such that the pinch roller 24 presses the drive roller 21. According to the shown embodiment, the cam surface 102 of the releasing cam 101 has a shape formed that a distance between the pinch roller 24 and the drive roller 21 is approximately 2 mm. However, it is understood that other distances can be used.

The one-way clutch 107 is interposed between the releasing cam 101 and the drive roller shaft 22, and causes the releasing cam 101 to rotate in one direction. In the shown embodiment, the one-way clutch 107 is disposed at the drive roller shaft 22 in one direction, and the releasing cam 101 rotates counter-clockwise but not clockwise. However, other locations and directions are possible. The torsion spring 105 is at the drive roller shaft 22, with one end thereof being supported by a projection 103 of a side of the releasing cam 101 and the other end being supported by a supporting portion 110 formed at a body of the ink-jet printer. Therefore, the releasing cam 101 receives a force from the torsion spring 105 that causes the releasing cam 101 to be biased to rotate counter-clockwise. Thus, the cam surface 102 of the releasing cam 101 remains in contact with the pinch roller shaft 25.

As shown in FIGS. 5–7 and 9, the controller 60 is one which is used in a conventional ink-jet printer, but which also performs additional control operations discussed below. The controller 60 senses using a sensor 111 the length that a front end of a printing material 1, which is received from the drive roller 21 and is moved into the feed roller 30. When the front end of the printing material 1 is moved a predetermined length into the feed roller 30, the controller 60 rotates a drive motor 28 of the drive roller assembly in the opposite direction such that the releasing cam 101 separates the pinch roller 24 from the drive roller 21.

An embodiment of the present invention will be described as to its operations referring to FIGS. 5 through 9. When an ink-jet printer is provided with electricity, the pinch roller 24 contacts the drive roller 21 and presses against the drive roller 21 due to force provided by the pinch spring 26. At this time, the releasing cam 101 rotates counter-clockwise due to a torsion spring 105 so that the cam surface 102 of the releasing cam 101 contacts the pinch roller shaft 25. When the controller 60 receives a print command from a computer (not shown), a pick-up roller 10 is rotated, and the print material 1 stacked within a printing material cassette 11 is moved into the drive roller assembly. When a front end of the print material 1 moved by the pick-up roller 10 is moved into a gap between the drive roller 21 and the pinch roller 24, the print material 1 is transferred to the feed roller 30 by the drive roller 21 rotating clockwise. As shown, the printing material detecting sensor 111 is disposed below the drive roller 21 and senses the printing material 1 is moved into the drive roller assembly. And then, if the front end of the print material 1 is detected by the printing material detecting sensor 111, the controller 70 rotates the drive motor 28 of the drive roller assembly to rotate the drive roller 21 clockwise.

Here, although the drive roller shaft 22 is rotated clockwise by the drive motor 28 as described above, a releasing cam 101, which is disposed at a one-way clutch 107 inserted in the drive roller shaft 22 and rotated counter-clockwise by a torsion spring 105, remains in contact with the pinch roller shaft 25. When the front end of the print material 1 is moved by the drive roller assembly by a predetermined length into the feed roller 30, the controller 70 rotates the drive motor 28 in the opposite direction. According to the shown embodiment, the predetermined length is approximately 3 to 5 mm. However, other predetermined lengths can be used.

When the drive motor 28 is rotated in the opposite direction, the drive roller shaft 22 is rotated counter-clockwise. When the drive roller shaft 22 is rotated counter-clockwise, the releasing cam 101, disposed at the one-way clutch 107 installed on the drive roller shaft 21, is also rotated counter-clockwise together. When the releasing cam 101 is rotated counter-clockwise, the pinch roller shaft 25 is pushed in the pinch spring's direction by the cam surface 102 of the releasing cam 101 so that the pinch roller 24 is separated from the drive roller 21 by the predetermined distance. When the pinch roller 24 is separated from the drive roller 21, the print material 1 that has passed through the drive roller assembly is free from the friction force between the pinch roller 24 and the drive roller 21 of the drive roller assembly. Therefore, the portion of the printing material 1 between the drive roller assembly and the feed roller 30 falls down by gravity. Thus, a curl of a print material 1, which is otherwise formed when the front end of the print material 1 is moved into the feed roller 30, disappears.

At this time, because the feed roller 30 is rotated clockwise, the print material 1 moved into the feed roller 30 is fed to be below printing unit 40. Therefore, the print material 1 is printed by the printing unit 40.

According to an embodiment of the present invention, when the print material 1 is fed to be below the printing unit 40 by the feed roller 30, the print material 1 does not receive an additional force due to a spring-back effect of a curl of a print material 1 as occurs in the printer shown in FIG. 1. Therefore, the feed roller 30 feeds the print material 1 in the predetermined length uniformly, and the band feed accuracy is improved.

However, when the drive roller 22 is rotated in the opposite direction, the print material 1 between the pinch roller 24 and the drive roller 21 receives the opposite force. Thus, print material 1 is fed approximately 0.5 mm in the opposite direction. As such, a reverse feeding indicates the movement that the print material 1 is moved as described above. The reverse feeding does not influence the band feed accuracy, but does delay feeding the print material 1.

Figure 8:
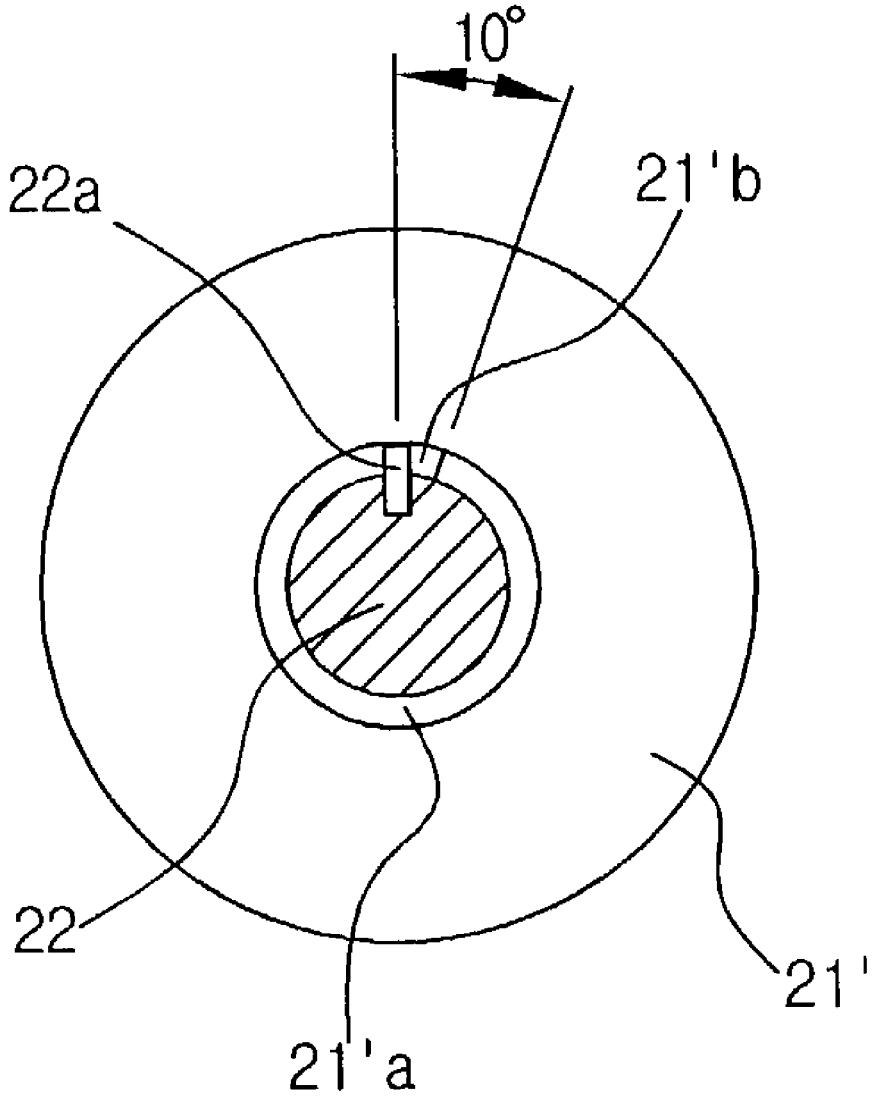
FIG. 8 is a cross-sectional view showing a drive roller having a delay structure according to an embodiment of the invention.
Figure 9:
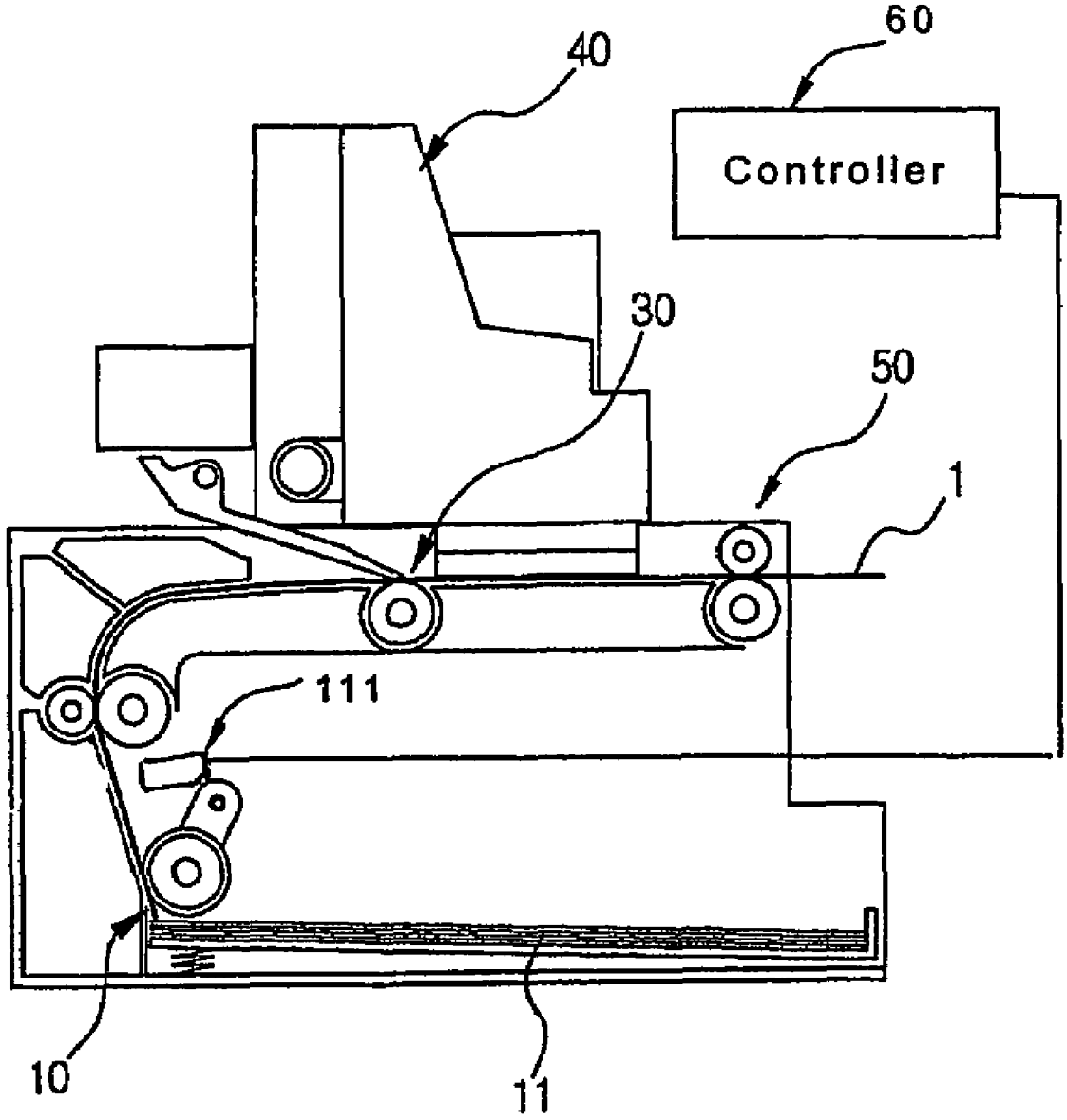
FIG. 9 shows an ink-jet printer using the drive roller assembly of FIG. 5.

To remove the reverse feeding, a drive roller 21' having a delay structure is used according to an embodiment of the invention shown in FIG. 8. Referring to FIG. 8, the drive roller 21' having a delay structure has a hub 21'*a* inserted therein. The hub 21'*a* is inserted on the drive roller shaft 22 and the drive roller shaft 22. The hub 21'*a* has a keyway 21'*b* for a key 22*a* mounted on the drive roller shaft 22. The width of the keyway 21'*b* is wider than the width of the key 22*a* disposed within the keyway 21'*b*. Generally, the width of the keyway 21'*b* is 10 degrees wider than the width of the key 22*a*. However, it is understood that other widths can be used to effect other amounts of delay.

An operation of the drive roller 21' having a delay structure as described above will be explained below. When a drive roller shaft 22 is rotated in one direction, the key 22*a* mounted at the drive roller shaft 22 contacts one side of the keyway 21'*b* of the hub 21'*a*. Thus, the drive roller 21' is rotated in the same direction together with the drive roller shaft 22. However, when the drive roller shaft 22 is rotated in the opposite direction, the drive roller 21' having the delay structure is not rotated until the other side of the keyway 21'*b* contacts the key 22*a*. After the other side of the keyway 21'*b* contacts the key 22*a*, the drive roller 21' rotates in the rotation direction of the drive roller shaft 22. In other words, when the drive roller shaft 22 is rotated in the opposite direction during a rotation, there is a predetermined period of time that the drive roller 21' is not rotated.

Accordingly, when the drive roller 21' is used in a drive roller releasing apparatus according to the present invention, though the drive roller shaft 22 is rotated in the opposite direction so as to separate the pinch roller 24 from the drive roller 21, the reverse feeding of the printing material does not occur.

Consequently, using the drive roller releasing apparatus of the present invention, the print material does not have the curl occurring between the feed roller and the drive roller assembly, and the band feed accuracy of the print material by the feed roller remains good. Therefore, poor print quality due to an irregular band feeding is prevented.

Although the embodiments of the present invention have been described, it is understood that the present invention should not be limited to these preferred embodiments but various changes and modifications can be made by one skilled in the art within the spirit and scope of the present invention as hereinafter claimed and equivalents thereof.

What is claimed is:

1. A drive roller releasing apparatus for use with a drive roller, which transports print material to a feed roller using a pinch roller, in an ink-jet printer, the apparatus comprising:

a drive roller separating mechanism attached to a shaft of the drive roller, the drive roller separating mechanism to separate the drive roller from the pinch roller and which is detachably in contact longitudinally with the drive roller so as to apply pressure to the drive roller; and a controller to control said drive roller separating mechanism so as to separate the pinch roller from the drive roller when the print material is moved into the feed roller, wherein said drive roller separating mechanism comprises:

a releasing cam disposed at the drive roller shaft and having a cam surface in contact with a pinch roller shaft of the pinch roller, the cam surface being shaped such that the pinch roller is gradually separated from the drive roller according to a rotation of the drive roller shaft;

a one-way clutch disposed between the releasing cam and the drive roller shaft, the one-way clutch allowing the releasing cam to be rotated in one direction; and a torsion spring at the drive roller shaft, the torsion spring to bias the releasing cam to rotate in the one direction in order for the cam surface to remain in contact with the pinch roller shaft.

2. The drive roller releasing apparatus of claim 1, wherein the one-way clutch is rotated counter-clockwise.

3. The drive roller releasing apparatus of claim 1, wherein a distance by which the drive roller releasing apparatus separates the pinch roller from the drive roller is 2 mm.

4. The drive roller releasing apparatus of claim 1, wherein the drive roller is not rotated if the drive roller shaft is rotated in a reverse direction within a predetermined angle, but is rotated in the reverse direction with the drive roller shaft if the drive roller shaft is rotated in the reverse direction at more than the predetermined angle.

5. The drive roller releasing apparatus of claim 4, wherein the predetermined angle is 10 degrees.

6. The drive roller releasing apparatus of claim 1, wherein a length that the print material is moved into the feed roller is at or between 3 mm and 5 mm.

7. The drive roller releasing apparatus of claim 1, wherein the drive roller releasing apparatus separates the pinch roller from the drive roller by 2 mm.

8. A drive roller releasing apparatus for use with a drive roller, which transports print material to a feed roller using a pinch roller, in an ink-jet printer, the apparatus comprising:

a drive roller separating mechanism disposed at a shaft of the drive roller, the drive roller separating mechanism to separate the drive roller from the pinch roller and which is detachably in contact longitudinally with the drive roller so as to apply pressure to the drive roller; and a controller to control said drive roller separating mechanism so as to separate the pinch roller from the drive roller when the print material is moved into the feed roller, wherein the drive roller is not rotated if the drive roller shaft is rotated in a reverse direction within a predetermined angle, but is rotated in the reverse direction with the drive roller shaft if the drive roller shaft is rotated in the reverse direction at more than the predetermined angle.

9. The drive roller releasing apparatus of claim 8, wherein the predetermined angle is 10 degrees.

10. The drive roller releasing apparatus of claim 9, wherein:

said drive roller separating mechanism includes a releasing unit disposed on a shaft of the drive roller and having a surface in contact with a pinch roller shaft of the pinch roller so as to separate the drive roller from the pinch roller in accordance with a rotational direction of the drive roller shaft, and said controller controls the rotational direction of the drive roller shaft so as to control the separation of the drive roller from the pinch roller.

11. The drive roller releasing apparatus of claim 10, further comprising a sensor that senses a position of the print material, wherein said controller controls the rotational direction of the drive roller shaft in accordance with the sensed position of the print material sensed by said sensor.

12. The drive roller releasing apparatus of claim 11, wherein said sensor senses that the print material is to be advanced to the feed roller.

13. The drive roller releasing apparatus of claim 12, wherein:

said sensor senses when a predetermined amount of the print material has been advanced to the feed roller, and said controller controls the rotational direction of the drive roller shaft to separate the pinch roller and the drive roller when said sensor senses that the predetermined amount of the print material has been advanced to the feed roller.

14. The drive roller releasing apparatus of claim 11, wherein the surface of the releasing unit has a curvature that, according to a rotational movement of the releasing unit, separates the pinch roller from the drive roller as the releasing unit is rotated.

15. A drive roller releasing apparatus for use with a drive roller, which transports print material to a feed roller using a pinch roller, in an ink-jet printer, the apparatus comprising:

a drive roller separating mechanism attached to a shaft of the drive roller, the drive roller separating mechanism to separate the drive roller from the pinch roller when the print material is at the feed roller and which is detachably in contact with the drive roller so as to apply pressure to the drive roller, wherein said drive roller separating mechanism comprises:

a releasing cam disposed at the drive roller shaft and having a cam surface in contact with a pinch roller shaft of the pinch roller, the cam surface being shaped such that the pinch roller is gradually separated from the drive roller according to a rotation of the drive roller shaft;

a one-way clutch disposed between the releasing cam and the drive roller shaft, the one-way clutch allowing the releasing cam to be rotated in one direction; and a torsion spring at the drive roller shaft, the torsion spring to bias the releasing cam to rotate in the one direction in order for the cam surface to remain in contact with the pinch roller shaft.

16. The drive roller releasing apparatus of claim 15, wherein the one-way clutch is rotated counter-clockwise.

17. The drive roller releasing apparatus of claim 15, wherein:

said drive roller separating mechanism includes a releasing unit disposed on a shaft of the drive roller and having a surface in contact with a pinch roller shaft of the pinch roller so as to separate the drive roller from the pinch roller in accordance with a rotational direction of the drive roller shaft, and the separation of the drive roller from the pinch roller is controlled by a rotational direction of the drive roller shaft.

18. The drive roller releasing apparatus of claim 17, wherein the surface of the releasing unit has a curvature that, according to a rotational movement of the releasing unit, separates the pinch roller from the drive roller as the releasing unit is rotated.

19. A drive roller releasing apparatus for use with a drive roller, which transports print material to a feed roller using a pinch roller, in an ink-jet printer, the apparatus comprising:

a drive roller separating mechanism disposed at a shaft of the drive roller, the drive roller separating mechanism to separate the drive roller from the pinch roller when the print material is at the feed roller and which is detachably in contact with the drive roller so as to apply pressure to the drive roller, wherein said drive roller separating mechanism comprises:

a releasing cam disposed at the drive roller shaft and having a cam surface in contact with a pinch roller shaft of the pinch roller, the cam surface being shaped such that the pinch roller is gradually separated from the drive roller according to a rotation of the drive roller shaft;

a one-way clutch disposed between the releasing cam and the drive roller shaft, the one-way clutch allowing the releasing cam to be rotated in one direction; and a torsion spring at the drive roller shaft, the torsion spring to bias the releasing cam to rotate in the one direction in order for the cam surface to remain in contact with the pinch roller shaft, and wherein the drive roller is not rotated if the drive roller shaft is rotated in a reverse direction within a predetermined angle, but is rotated in the reverse direction with the drive roller shaft if the drive roller shaft is rotated in the reverse direction at more than the predetermined angle.

20. The drive roller releasing apparatus of claim 19, further comprising a delay structure disposed at the drive roller and the drive roller shaft, said delay structure comprising:

a key extending radially from the drive roller shaft, and an opening in the drive roller and into which the key is fitted, the opening having a width greater than a width of the key so as to allow the drive roller shaft to rotate within the predetermined angle without rotating the drive roller.

21. A printer to print information on a print material, comprising:

a printing unit to print the information on the print material;

a feed roller to feed the print material under said printing unit;

a pinch roller;

a drive roller having a drive roller shaft, said drive roller to transport the print material to said feed roller using said pinch roller;

a drive roller separating mechanism attached to the shaft of said drive roller, said drive roller separating mechanism to separate said drive roller from said pinch roller and which is detachably in contact with said drive roller so as to apply pressure to said drive roller; and a controller to control said drive roller separating mechanism so as to separate said pinch roller from said drive roller when the print material is moved into said feed roller, wherein said drive roller separating mechanism comprises:

releasing cam disposed at the drive roller shaft and having a cam surface in contact with a portion of said pinch roller, the cam surface being shaped such that said pinch roller is gradually separated from said drive roller according to a rotation of the drive roller shaft;

a one-way clutch disposed between the releasing cam and the drive roller shaft, the one-way clutch allowing the releasing cam to be rotated in one direction; and a torsion spring at the drive roller shaft, the torsion spring to bias the releasing cam to rotate in the one direction in order for the cam surface to remain in contact with the portion of said pinch roller.

22. The printer of claim 21, wherein the one-way clutch is rotated counter-clockwise.

23. The printer of claim 21, wherein:

said drive roller separating mechanism includes a releasing unit disposed on the drive roller shaft and having a surface in contact with a pinch roller shaft of said pinch roller so as to separate said drive roller from said pinch roller in accordance with a rotational direction of the drive roller shaft, and said controller controls the rotational direction of the drive roller shaft so as to control the separation of said drive roller from said pinch roller.

24. The printer of claim 23, further comprising a sensor that senses a position of the print material, wherein said controller controls the rotational direction of the drive roller shaft in accordance with the sensed position of the print material sensed by said sensor.

25. The printer of claim 24, wherein said sensor senses that the print material is to be advanced to said feed roller.

26. The printer, of claim 25, wherein:

said sensor senses when a predetermined amount of the print material has been advanced to said feed roller, and said controller controls the rotational direction of the drive roller shaft to separate said pinch roller and said drive roller when said sensor senses that the predetermined amount of the print material has been advanced to the feed roller.

27. The printer of claim 23, wherein the surface of the releasing unit has a curvature that, according to a rotational movement of the releasing unit, separates said pinch roller from said drive roller as the releasing unit is rotated.

28. A printer to print information on a print material, comprising:

a printing unit to print the information on the print material;

a feed roller to feed the print material under said printing unit;

a pinch roller;

a drive roller having a drive roller shaft, said drive roller to transport the print material to said feed roller using said pinch roller;

a drive roller separating mechanism disposed at the shaft of said drive roller, said drive roller separating mechanism to separate said drive roller from said pinch roller and which is detachably in contact with said drive roller so as to apply pressure to said drive roller; and a controller to control said drive roller separating mechanism so as to separate said pinch roller from said drive roller when the print material is moved into said feed roller, wherein said drive roller is not rotated if the drive roller shaft is rotated in a reverse direction within a predetermined angle, but is rotated in the reverse direction with the drive roller shaft if the drive roller shaft is rotated in the reverse direction at more than the predetermined angle.

29. The printer of claim 28, further comprising:

a key that extends radially from one of said drive roller and the drive roller shaft, and an opening in the other of the drive roller shaft and said drive roller and into which said key is fitted, said opening having a width greater than a width of said key so as to allow the drive roller shaft to rotate within the predetermined angle without rotating said drive roller.

30. The printer of claim 29, wherein said drive roller separating mechanism comprises:

a releasing cam disposed at the drive roller shaft and having a cam surface in contact with a portion of said pinch roller, the cam surface being shaped such that said pinch roller is gradually separated from said drive roller according to a rotation of the drive roller shaft;

a one-way clutch disposed between the releasing cam and the drive roller shaft, the one-way clutch allowing the releasing cam to be rotated in one direction; and a torsion spring at the drive roller shaft, the torsion spring to bias the releasing cam to rotate in the one direction in order for the cam surface to remain in contact with the portion of said pinch roller.

* * * * *

UNITED STATES PATENT AND TRADEMARK OFFICE

CERTIFICATE OF CORRECTION

PATENT NO. : 7,001,017 B2
APPLICATION NO. : 10/234316
DATED : February 21, 2006
INVENTOR(S) : Yong-duk Lee et al.

It is certified that error appears in the above-identified patent and that said Letters Patent is hereby corrected as shown below:

First Page, Column 2 (Foreign Patent Documents), after "3/1982" insert -- B41J 11/20 --.
First Page, Column 2 (Foreign Patent Documents), after "10/1983" insert -- B41J 13/10 --.
First Page, Column 2 (Foreign Patent Documents), after "9/1984" insert --B41J 13/00 --.
Column 10, Line 22, delete "printer, of" and insert -- printer of -- therefor.

Signed and Sealed this

Eighth Day of August, 2006

JON W. DUDAS
*Director of the United States Patent and Trademark Office*